US007798907B2

(12) United States Patent
Piccionelli et al.

(10) Patent No.: US 7,798,907 B2
(45) Date of Patent: Sep. 21, 2010

(54) TARGET GAME APPARATUS AND SYSTEM FOR USE WITH A TOILET

(76) Inventors: Gregory A. Piccionelli, 1925 Century Park East, Suite 2350, Los Angeles, CA (US) 90067; Gary Friedman, 18840 Ventura Blvd., Suite 226, Tarzana, CA (US) 91356

( * ) Notice: Subject to any disclaimer, the term of this patent is extended or adjusted under 35 U.S.C. 154(b) by 1467 days.

(21) Appl. No.: 11/126,856

(22) Filed: May 10, 2005

(65) Prior Publication Data

US 2005/0288105 A1 Dec. 29, 2005

Related U.S. Application Data

(63) Continuation-in-part of application No. 10/215,684, filed on Aug. 10, 2002, now Pat. No. 6,908,392.

(60) Provisional application No. 60/312,932, filed on Aug. 16, 2001.

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/49; 434/247; 363/1; 273/342; 273/349; 273/350; 4/301; 4/661; 441/129

(58) Field of Classification Search ..... None
See application file for complete search history.

(56) References Cited

U.S. PATENT DOCUMENTS

| | | | | | |
|---|---|---|---|---|---|
| 2,703,407 | A | * | 3/1955 | Henoch et al. | 434/247 |
| 3,134,594 | A | * | 5/1964 | Crowley | 273/350 |
| 3,430,958 | A | * | 3/1969 | Lakeman | 473/481 |
| 3,469,844 | A | * | 9/1969 | Sindelar | 273/350 |
| 3,652,090 | A | * | 3/1972 | Semmens | 273/336 |
| 3,778,060 | A | * | 12/1973 | Lakeman | 273/342 |
| 3,989,250 | A | * | 11/1976 | Lakeman | 273/350 |
| 4,044,405 | A | * | 8/1977 | Kreiss | 434/247 |
| 4,223,894 | A | * | 9/1980 | Fabricant | 273/349 |
| 4,345,765 | A | * | 8/1982 | Wang | 273/359 |
| 4,412,680 | A | * | 11/1983 | Zorn | 273/349 |
| 4,612,676 | A | | 9/1986 | Whitman | |
| 4,744,113 | A | * | 5/1988 | Kogut | 4/661 |
| 4,773,863 | A | | 9/1988 | Douglas et al. | |
| 4,775,346 | A | * | 10/1988 | Gunter et al. | 441/129 |
| 5,005,224 | A | | 4/1991 | Carmichael et al. | |
| 5,031,253 | A | * | 7/1991 | Brendlinger | 4/300.3 |
| 5,117,512 | A | | 6/1992 | Bressler et al. | |
| 5,117,515 | A | * | 6/1992 | White et al. | 4/661 |

(Continued)

*Primary Examiner*—John M. Hotaling, II
*Assistant Examiner*—Paul A. D'Agostino
(74) *Attorney, Agent, or Firm*—Gregory A. Piccionelli

(57) ABSTRACT

Embodiments of the present invention are directed to an apparatus and system for a target game used in conjunction with a toilet or urinal, wherein a target body is positioned within the toilet basin. The target game comprises a target body and coupling members, wherein the target body is divided into sections. The coupling members secure the target body to the toilet basin and include a securing member and an attachment member, wherein the securing member is any device that is capable of attaching to the toilet and wherein the attachment member couples the securing member to the target body. Other embodiments of the apparatus and system include image projection systems to create the target.

1 Claim, 4 Drawing Sheets

U.S. PATENT DOCUMENTS 5,223,958 A * 6/1993 Berry ..... 349/20
5,358,742 A * 10/1994 Ziff ..... 427/276
5,421,585 A * 6/1995 Ruvio ..... 273/338
5,460,113 A * 10/1995 Gunter ..... 114/230.2
D364,595 S * 11/1995 Doyle ..... D12/168
5,595,387 A 1/1997 Senna
5,613,457 A * 3/1997 Frank et al. ..... 114/218
5,785,439 A 7/1998 Bowen et al.
5,809,590 A * 9/1998 Williams et al. ..... 4/661
5,810,632 A * 9/1998 Huston, III ..... 441/129
5,823,849 A * 10/1998 Gardner et al. ..... 446/473
5,848,793 A 12/1998 Celis
5,890,242 A 4/1999 Minter et al.
5,926,867 A * 7/1999 Buchanan ..... 4/661
5,988,645 A 11/1999 Downing et al.
6,055,681 A * 5/2000 Lyons ..... 4/300.3
6,385,796 B1 5/2002 Muir, Jr.
6,475,048 B2 * 11/2002 Gredy ..... 441/129
6,513,173 B1 * 2/2003 Sykes ..... 4/301
6,666,161 B1 * 12/2003 Cannon et al. ..... 114/294
6,772,454 B1 8/2004 Barry et al.
6,779,206 B1 * 8/2004 Sykes ..... 4/661
6,811,403 B1 * 11/2004 Camarena ..... 434/258
6,908,392 B2 * 6/2005 Friedman et al. ..... 463/49
7,464,937 B1 * 12/2008 Maggio ..... 273/350

* cited by examiner

TARGET GAME APPARATUS AND SYSTEM FOR USE WITH A TOILET

RELATED APPLICATIONS

This application is a continuation-in-part of pending U.S. patent application, entitled Target Game Apparatus and System for Use With A Toilet, Ser. No. 10/215,684, filed Aug. 10, 2002 now U.S. Pat. No. 6,908,392, which claims the benefit from U.S. patent application, entitled Target Game Apparatus and System for Use With A Toilet, Ser. No. 60/312,932 filed Aug. 16, 2001, which are fully incorporated herein by reference.

FIELD OF THE INVENTION

The present invention relates to a target game apparatus and system for use in a toilet or urinal. More particularly, the present invention relates to a paper version game and an electronic game version having video game type features.

BACKGROUND OF THE INVENTION

Games are an enjoyable past time for most people. Games allow the learning of new skills and concepts, including mental and physical skills. Indeed, games often assist parents to teach young children desirable habits and behavior.

One area of behavior that parents often have problems training small children, in particular, young boys, is proper toilet use when urinating. Young boys often do not accurately aim into the toilet bowl when urinating often creating a mess on the surrounding floor and toilet seat. The creation of a game or challenge of some sort can often peak a child's interest such that the desired behavior can be learned and performed. A need in the industry exists for a game or apparatus that will aid in the development of proper toilet use for urination purposes by males.

BRIEF DESCRIPTION OF THE DRAWINGS

The detailed description of embodiments of the invention will be made with reference to the accompanying drawings, wherein like numerals designate corresponding parts in the figures.

SUMMARY OF THE DISCLOSURE

Figure 1:
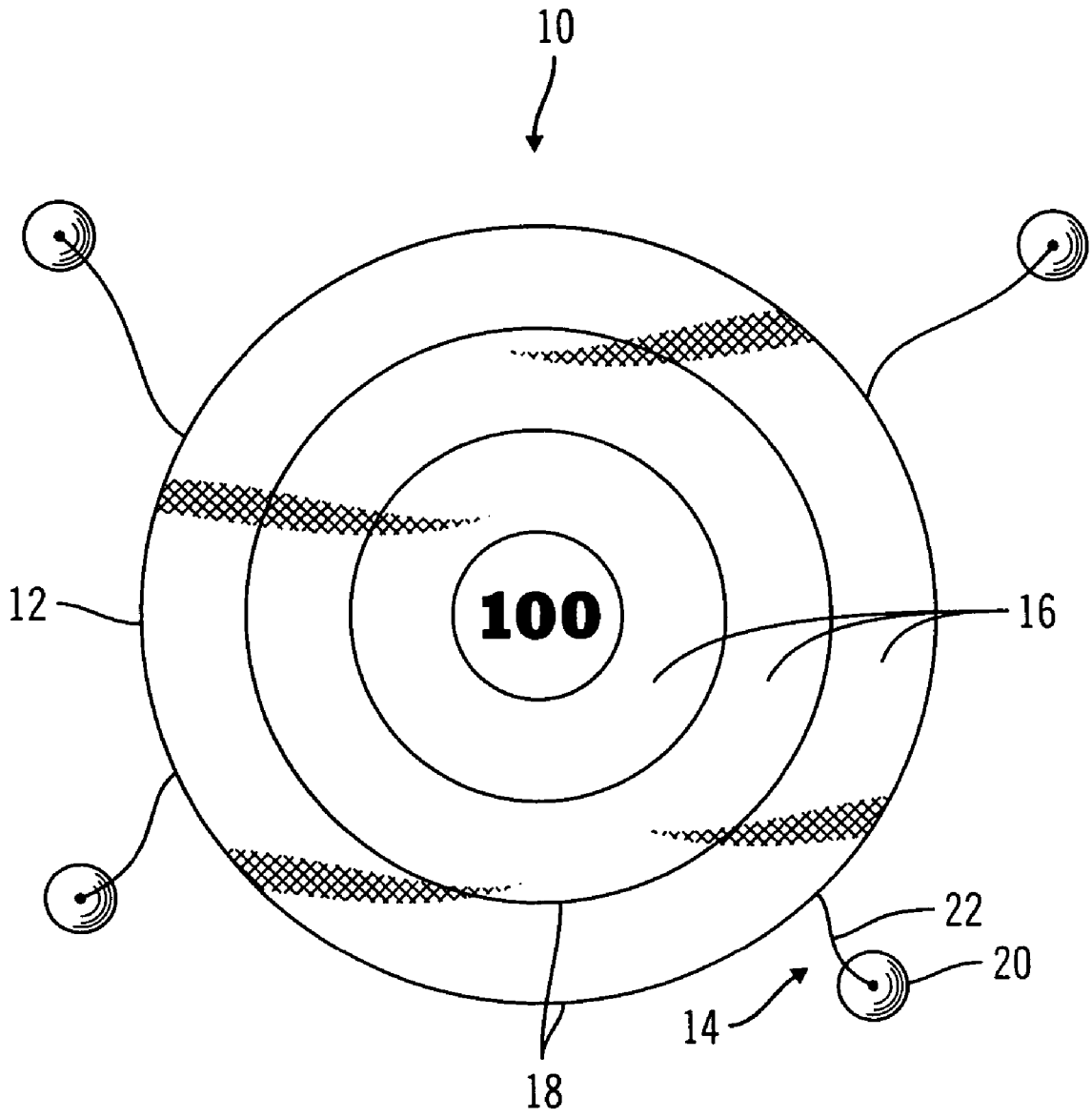
FIG. 1 depicts a target game in accordance with preferred embodiments of the invention.

Embodiments of the present invention are directed to an apparatus and system for a target game used in conjunction with a toilet or urinal, wherein a target body is positioned within the toilet basin and is capable of floating on the water contained within the basin of the toilet. In preferred embodiments, the target game comprises a target body and coupling members. The target body is made from a thin material which is divided into sections. The material of the target body can be coated such that it can change colors, or hide the target image until a liquid, such as urine, is applied to the body. The image on the target body can be representative of any theme.

The coupling members secure the target body to the toilet basin. In one preferred embodiment, the coupling members include a securing member and an attachment member, wherein the securing member is any device that is capable of attaching to the toilet and wherein the attachment member couples the securing member to the target body. It is to be understood that some preferred embodiments do not include the coupling members.

Embodiments of the invention can be varied in multiple ways. For instance, in some preferred embodiments, the target game is electronic wherein the target body can be created by various means, including holographic means. In some of these embodiments, a game grid is electronically generated via a set of emitters and sensors, wherein the sensors detect the relative movement of a fluid stream. In some embodiments, the movement of the fluid stream corresponds to the control of a cursor on a display means. Electronic versions of the system can include features contained in video type games and programs. For instance, in some embodiments, a heads up display can be used in conjunction with the set of sensors and emitters such that a computer type game is created.

A feature of preferred embodiments is that the target body can be made from any suitable material. An advantage to this feature is that multiple types of uses can be established by changing the type of material from which the body is made, such as, medical analysis of urine.

A further feature of preferred embodiments is that the target body creates a game. An advantage to this feature is that small boys can be more effectively trained to properly utilize the toilet. A further advantage to this feature is that the game will facilitate a more positive experience for small boys learning to use the toilet facilities and thus, may encourage proper use of the facilities.

A still further feature of preferred embodiments is that the system can be electronically generated. An advantage to this feature is that any type of target can be generated, thereby allowing the creation of multiple games and experiences for the user.

The above and other advantages of embodiments of this invention will be apparent from the following more detailed description when taken in conjunction with the accompanying drawings. It is intended that the above advantages can be achieved separately by different aspects of the invention and that additional advantages of this invention will involve various combinations of the above independent advantages such that synergistic benefits may be obtained from combined techniques.

DETAILED DESCRIPTION OF PREFERRED EMBODIMENTS

Embodiments of the present invention are directed to an apparatus and system for a target game used in conjunction with a toilet or urinal. More specifically, embodiments of the present invention comprise a target body that is positioned within the toilet basin and is capable of floating on the water contained within the basin of the toilet. Embodiments of the invention can be utilized with any type of urinal, including, but not limited to, stand-up wall type urinals or standard floor type urinals.

With reference to FIG. 1, in one preferred embodiment, the target game 10 comprises a target body 12 and coupling members 14. The target body 12 is a thin sheet divided into sections 16, which are demarcated by a sectional division 18. The target body can be representative of any theme. For example, in addition to the traditional target theme with numbers, as shown in FIG. 1, the sections can be divided with animal pictures, geometric shapes, political figures (for adults), ships, monsters and the like.

In some preferred embodiments the images can be satryical in which the user urinates on a picture of a political figure or a despised national enemy. In other embodiments, the image can be custom created from a digitized photograph, such as a photograph of an employer, ex-spouse, or roommate. In some preferred embodiments, the target game is affiliated with an online distributor, wherein a user, via a user computer, can access the distributor computer and forward the photograph to the distributor, or target generating company, via the network. It is to be understood that the transfer of such photographic data is in accordance with commonly understood methods, such as, transmission of data over a wide area network, such as, for example, the Internet, and is not set forth herein.

In preferred embodiments, the target body 12 is made from materials that can absorb some amount of water without immediately sinking below the water surface, but that is supple enough to be depressed or concave upon the shooting of a stream of liquid onto the surface such that splashing of the liquid is minimized. In one preferred embodiment, the sections are color coated such that upon a direct hit from a liquid stream, such as a urine stream, the coating releases the color into the toilet water such that the participant knows he has scored. The color coating substance is any substance that will release color upon contact with the force from a concentrated liquid stream, but is not harmful to the toilet bowl. In some preferred embodiments, the coating is colorametric and changes color upon contact with the urine of a particular pH, range of pH or chemical composition. In another preferred embodiment, the materials within each section is thinner than the sectional division 18 such that direct streams of liquid, such as urine, will tear the material, thereby signifying that the participant has hit the target and scored.

In other preferred embodiments, the material of the target body 12 is coated such that no image is viewable on the target body until a liquid, other than water, or a liquid having a temperature above a predefined amount, contacts the material. Upon contact with the predefined liquid, a chemical reaction with the material and the liquid occurs such that the image is revealed. In one preferred embodiment, the pH difference between the water and the urine causes the reaction with the coating on the material such that urinating on the target body 12 reveals the image at locations where the urine contacts the coating on the material. For example, a lottery ticket can be created utilizing a coating material such that a user must 'scratch off' the coating via urinating on the target body 12 and causing a chemical reaction to occur in order to reveal the lottery numbers. In still other embodiment, paper or other material is pre-treated or coated with a compound that reacts with urine to cause an event, such as, fizzing, or popping.

The coupling members 14 secure the target body 12 to the toilet basin. In one preferred embodiment, the coupling members 14 include a securing member 20 and an attachment member 22. The securing member 20 is any device that is capable of attaching to the toilet, including but not limited to, a suction cup, bonding material or puddy. The attachment member 22 couples the securing member 20 to the target body 12. The attachment member 22 can be any device that connects the target body 12 to the securing member 20, including, but not limited to, a string, a rope, a cord, or a retractable cord. The attachment member 22 is coupled to the target body 12 via any suitable means. In one embodiment, the attachment member 22 is pushed through a precut portion of the target body 12 and knotted such that the knot prevents the attachment member 22 from releasing the target body 12. Other suitable means for the attachment member 22, include, but are not limited to, glue, a hook and latch, or a hook which can pierce the target body 12. It is to be understood that some preferred embodiments do not include the coupling members 14.

Figure 2:
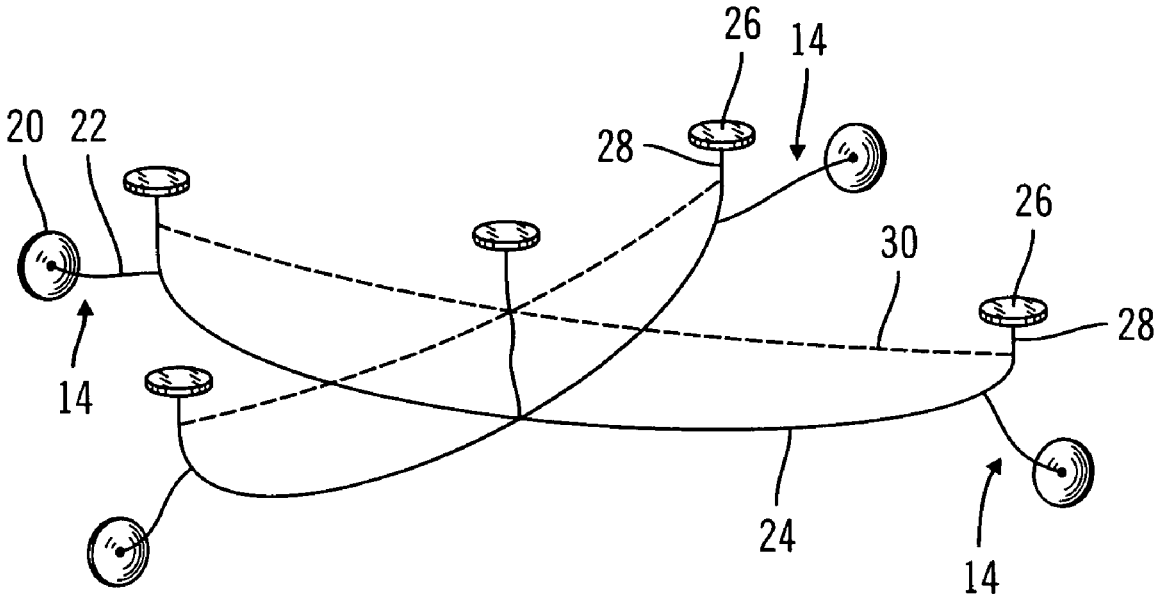
FIG. 2 depicts a target game in accordance with another preferred embodiment of the invention.

In another preferred embodiment, with reference to FIG. 2, the target body 14 comprises a frame 24 and a plurality of target members 26. The frame 24 is in the shape of a cross, wherein the cross is slightly concave to allow it to easily fit in the toilet bowl. The coupling members 14 are coupled to the frame 24 which allow the securing of the frame 24 to the toilet bowl. Depending upon the size of the frame 24 in reference to the size of the toilet bowl, the attachment members 22 of the coupling members 14 will be shortened or eliminated. Thus, in some preferred embodiments, the securing members 20 are directly attached to the frame 24.

The plurality of target members 26 create the sections of the target body 12. The target members 26 are comprised of any material that is capable of floating on the surface of the water in the toilet bowl, including, but not limited to, cork, plastic, or any other type of material having sufficient buoyancy to float. Each target member 26 is circular in shape, although any shape is suitable, including but not limited to, squares, triangles, ovals, octagons, and hexagons. Each target member 26 has a number or other value indicia embedded or printed on the target member 26 wherein the value indicia indicates scoring value for the game. In one preferred embodiment, the target members 26 can emit an odor, change color, light up or emit a sound upon being hit with a urine stream, thereby alerting the participant to the successful hitting of the target member 26.

The target members 26 are coupled to the frame 24 via a coupling member 28. The coupling member 28 can be stiff in nature or flexible, wherein if the coupling members 28 are flexible the target member 26 can move more freely. The more flexible coupling members 28 can create a more challenging game as the target pieces can move more freely on the surface of the water. In some preferred embodiments, to minimize some of the movement, a second cross shaped frame section 30 can also be included, wherein the second cross frame section 30 is attached closer to the target members 26 to reduce the movement of the target members 26. This second frame section 30 is illustrated in FIG. 2 with dotted lines.

In operation, prior to use, the target game 10 is installed in the toilet bowl. In embodiments, wherein the target game 10 is merely the target body, that is, a single sheet or a plurality of sheets of material, such as flushable paper, the participant places the target body in the toilet such that it freely floats on the surface of the water. In embodiments utilizing the coupling members 14, the securing members 20 are attached to a surface of the toilet bowl. The target body 12 of the embodiment in FIG. 1, or the frame 24 of the embodiment of FIG. 2, is then attached to the coupling members 14.

During use of the toilet, the participant, such as a young boy, aims the stream of urination at the sections of the target body 12, or the target members 26. A visual scoring can be maintained by the participant. Once the game is complete, the toilet can be flushed. In embodiments utilizing a target body 12 made from flushable material, as water is added to the toilet and flushed down the toilet, the target body 12 is flushed down the toilet with the water. If the target body 12 is attached to the coupling members 14, the target body 12 is pulled free from the coupling members 14 by the downward force of the water and flushed down the toilet. In embodiments utilizing the plurality of target members 26, the target members 26 are prevented from being flushed down the toilet via the coupling members 28 or second frame section 30.

It is clear from the above described embodiments that the target game 10 can be utilized by people of all ages. Indeed, other embodiments can allow for electronic scoring of the game or allow for competition among participants via a network.

For instance, in one embodiment and with reference to FIG. 2, the target game 10 further comprises a receiving box (not shown) and sensors (not shown), wherein the target members 26 comprise the sensors that transmit a signal to the receiving box via any suitable means, including, but not limited to, wired means or wireless means, including radio signal means such as those utilizing Blue Tooth™ technology, and chemico-electrical signal transmission means. It is to be understood that the sensor can also include any suitable apparatus capable of detecting a liquid stream. Upon a hitting of the target member 26 with a stream of liquid, the sensors transmit a signal to the receiving box which signifies a hit of the target. The value of the target member 26 is recorded in the receiving box and displayed for the participant. In some preferred embodiments, the sensors, such as, urine stream detector means, can be mounted or hung in a toilet or urinal. In some preferred embodiments, the target members 26 can be pressure sensitive such that a single or repeated amount of applied pressure that register can cause an increase in score.

In another preferred embodiment, the receiving box is connected to a network of computers, such as the World Wide Web. In this embodiment, participants can "play" against each other. The scores for each participant are recorded in a database that can be displayed or accessed by other participants. In some embodiments, participants can choose to play against a particular player. In still other embodiments, participants can utilize transportable devices, such as a personal digital assistant ("PDA"), wherein the scores of prior games are stored in the transportable device and can be downloaded, wirelessly, to the network from any participating facility, that is, a urinal. In still other embodiments, a PDA can store and transmit user defined games into the toilet game apparatus.

It is to be understood that configurations of the game can be played utilizing a wide variety of technologies that currently exist, such as a wireless remote. For instance, the game can be coupled to a heads up display, wherein a virtual target body is displayed in the heads up display corresponding to the area of the toilet bowl for the participant.

In some embodiments, a set of emitters (see for example, FIG. 3) generate a holographic image 50 inside the toilet bowl. In other preferred embodiments, the holographic image can be created by any suitable means, including, but not limited to, lasers, or pin lights coupled to the inside of the toilet bowl, via a heads up display, or a display behind the toilet. In this manner, three-dimensional holographic type games can be created, wherein a user could direct the movement through a holographic subject. For example, a user could experience viewing the depths of a mine shaft or urinating over the tops of skyscrapers, wherein the images are generated in the bowl via a holographic generation means. In some embodiments, a library of online holographic images and games can be downloaded from an image distributor via the network or via a local storage means, such as a disk, CD Rom, or DVD. It is to be understood that it is not required that a user use a stream detection device or physical target members on the bowl to use the holographic image feature as such feature could be used separately, for example, to view images, video content or audiovisual content.

In some preferred embodiments, the display can be placed remotely from the toilet. For instance, the display can be mounted behind or above the toilet or urinal.

Figure 3:
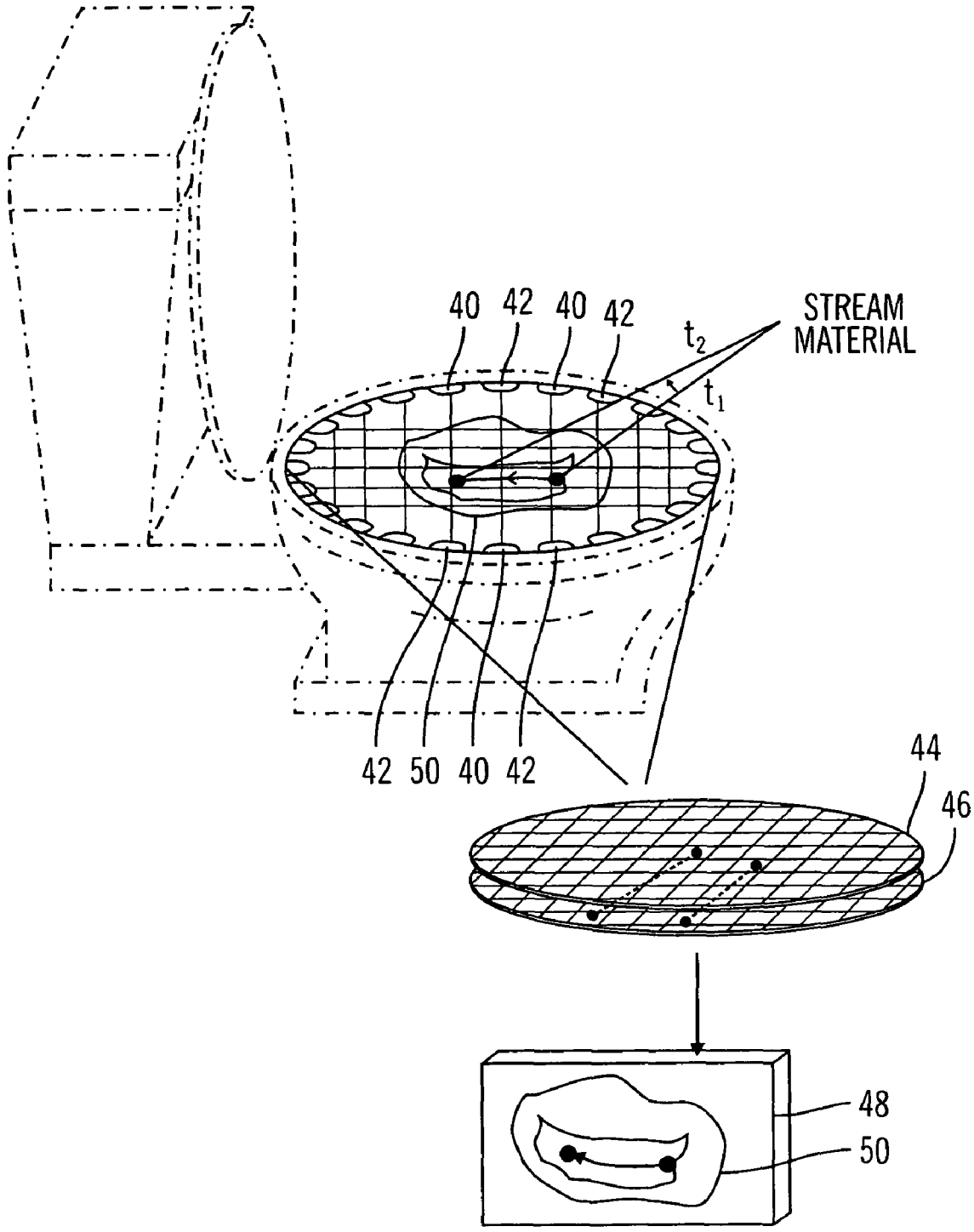
FIG. 3 depicts a sensor-emitter system for use with a target game in accordance with a preferred embodiment of the invention.

In some embodiments, the movement of the urine stream and contact with the sensors by the urine stream corresponds to control of the cursor, such as a pointer arrow, on the screen or activity on the screen and thereby acts as a control or input means for the user, analogous to a mouse, a keyboard or joy stick, thereby enabling the control of a computer or other microprocessors. With reference to FIG. 3, a plurality of emitters 40 and sensors 42 are lined around the interior of the toilet basin, or urinal, wherein the emitters 40 emit a laser beam, a light beam or other signal source which is sensed by a sensor to create a stream detection grid array across the toilet or urinal opening. The sensors 40 sense or detect materials passing through the grid system and record the relative location of the detected material for each grid array. Indeed, as material passes through the points on the grid array, the light beam is broken such that an x-y path of the passing material can be established. In some embodiments, a series of emitters 40 and sensors 42 are stacked, such that a three-dimensional x-y-z grid array system is formed. In this manner, third dimensional plane movement can be detected and established. In some preferred embodiments, such information can be associated with the passage of time, via a clock or any other suitable means, enabling the ascertainment of movement, rate, speed, acceleration, and volumetric measurements pertaining to the urine stream. Such data may be used to enable additional cursor control and game play applications. Further, such rate and pressure information can be used in a manner analogous to the sensing of velocity information in MDI systems. In such embodiments, the rate and pressure can be used to control, for example, the amplitude of sounds triggered in games or music programs.

If two or more grid arrays are present, a series of points can be recorded, wherein the series of points can determine a line of trajectory. As more entry points are detected for each grid level, movement on the grid array can be traced on a two or three-dimensional display. Indeed, in some preferred embodiments, the detection of the movement of the urine stream functions to control movement of the cursor position, similar to that of a mouse, keyboard or other suitable pointing device utilized on a computer, for example, to navigate and engage links on a web page or control other types of graphic user interfaces. Thus, for instance, the participant can play a game, such as, moving through a maze, engaging in a sword fight or extinguishing a fire by controlling the direction of the urine stream. Further, for instance, such control can enable the user to engage the playing of notes of a computer generated musical instrument triggerable by means such as MIDI, and the engagement of on screen menus and control panels. In some preferred embodiments, such controls can operate toilet functions such as flushing (see below) and dispersing of cleaners or scents. In one preferred embodiment, a detection system is utilized to allow for the tracking of movement via a multi-dimensional grid, wherein there is a plurality of detection systems that are configured to detect movement in the z axis, such that the angle and grid position of the urine stream can be calculated to greater degrees of precision. The detection system can be used with physical sensors, which may or may not be target members, or non-sensor target members, that is, the target members can be physical objects, or can be computer generated images.

The stream detection grid planes can be created by any available means, including, an array of pin point light beams or other signal means that align along the toilet bowl or urinal. Thus, in some preferred embodiments, the array of sensors is not coupled to the target body, but rather, the stream detector system is the means by which the screen cursor movement is directed. Indeed, a three-dimensional grid could be formed such that movement on a three-dimensional image area could be created. In this manner, a wide variety of games with various features could be played. For instance, in some preferred embodiments, sounds can be associated with the sensor contact such that a missing of the target corresponds to one type of sound, for example, the whizzing of a bullet, and the hitting of the target corresponds to a second type of sound, for example, a bomb exploding. In some instances, the audio is associated with the volume or pressure of the stream.

In some preferred embodiments, the stream detection means can be combined with the holographic generation means and thus, a holographic image can be altered and interacted with by the user. In some other preferred embodiments, the interaction can be a game, wherein the detection device in FIG. 3 allows for the acquisition of the information to control the cursor on the screen, wherein the screen is the holographic image 50. In some preferred embodiments, the holographic image generation can be in a heads up display or projected in front of, or around, the user.

Further still, in other preferred embodiments, a microprocessor control is operatively coupled to a flush valve operator of the toilet. The microprocessor causes the flushing of the toilet by opening an outlet control valve on the toilet, for example, by means of a solenoid. However, any automatic flushing means is suitable, including but not limited to, an electronic eye, a motion detector, sensors coupled to or embedded in the toilet, such as the bowl or seat, or detection grid system (discussed above). The flushing mechanisms of a toilet are well understood by those skilled in the art and will not be set forth herein. In some preferred embodiments, a microprocessor control can be coupled to a dispensing means for dispensing cleaner into the toilet or urinal or scented compounds into the air.

In some preferred embodiments, a portion of the displayed image or other projection produced in the bowl can correspond to an activator or a linking means, which when engaged, causes the toilet to flush, or cleaner or scents to be dispensed, or the occurrence of a predefined event.

In some preferred embodiments the flush function can be triggered when the grid detectors do not detect a urine stream for a set period of time. In these embodiments, the triggering of the flushing mechanism can occur by any suitable means, including, but not limited to, an electronic eye or motion detector system.

In some preferred embodiments, control of the cursor such as a pointer arrow, which controls or enters data into a computer or processor analogous to a keyboard, mouse or joy stick, is accomplished via a control device, which can be associated with one or more of a user's appendages, such as, a ring controller on the user's penis. In this embodiment, the user's movements translates to movement on screen, for example, wherein the penis ring information can be sent via short range electromagnetic wave transmission, including, but not limited to, Blue Tooth™ technology.

Figure 4:
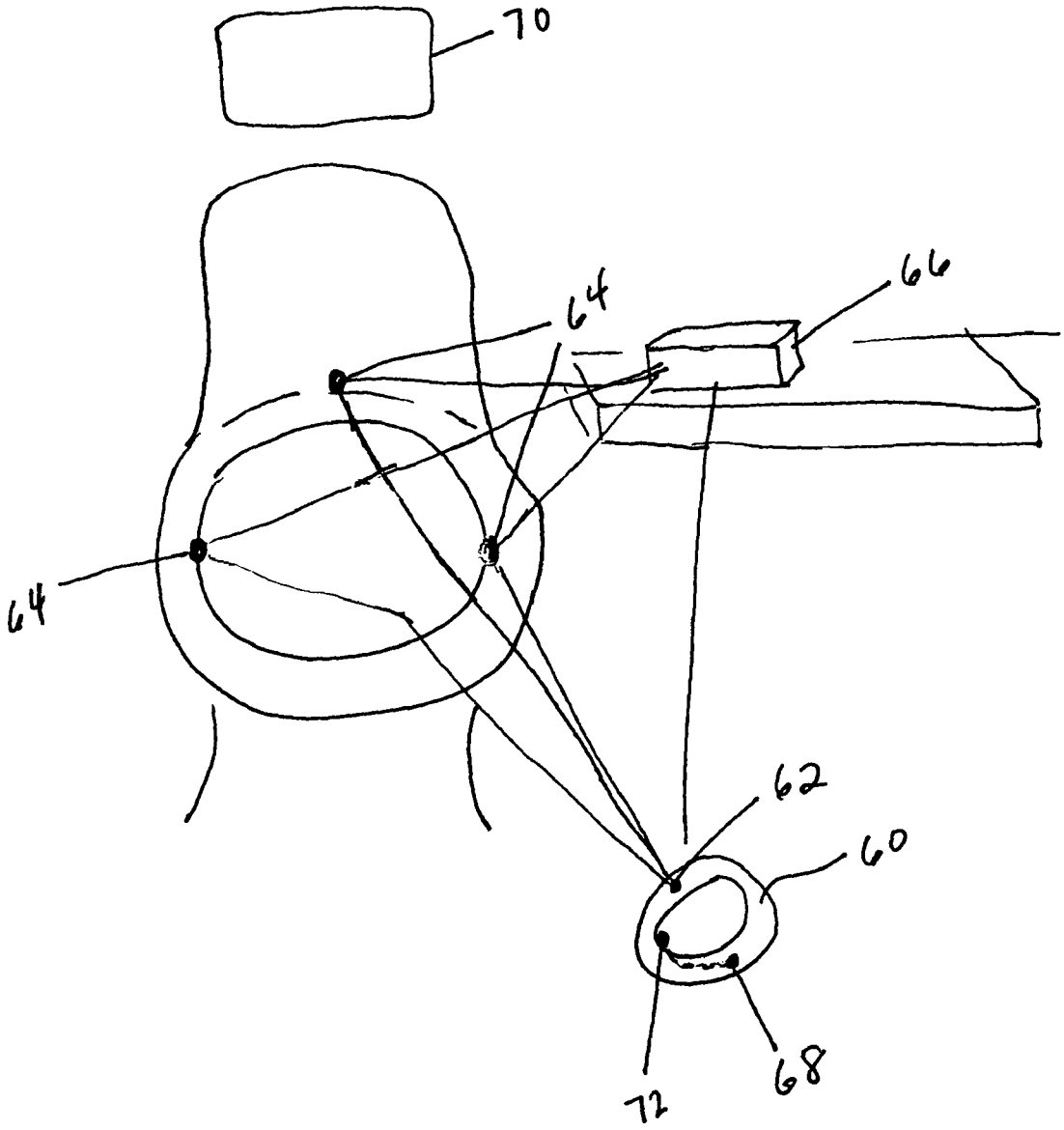
FIG. 4 depicts a ring controller used with a target game in accordance with a preferred embodiment of the invention.

In some embodiments, the input control that regulates the cursor, for example, is accomplished by one or more ring controllers. With reference to FIG. 4, the ring controller 60 is configured to slip around the shaft of the penis, or otherwise coupled thereto, such as by a clasp or other tying type mechanism, including Velcro®. The orientation of the ring, its center roughly corresponding with the opening of the urethra if the ring controller is slipped around the penis, can be correlated with direction of the urine flow from the penis at an angle roughly perpendicular to the plane of the ring controller 60. If the ring controller 60 is attached to the user, a correction can be made to account for the offset of the ring controller 60 from the center. The ring controller 60 comprises at least one transmitter 62 that emits a signal that is received by a plurality of receivers 64 that can be located on, in or around the toilet. The receivers 64 are in communication with a processor 66 that calculates the relative position of the ring controller 60 based upon the difference in time the signal from the transmitter 62 is received at the plurality of receivers. In this manner the direction of the urine stream can be ascertained. The receivers 64 can be in communication with the processor 66 by either wired or wireless means.

The penis ring controller can be used in lieu of or in addition to the light grid array. In the latter circumstance, the accuracy of the direction of the urine stream from the penis can be improved by comparing and averaging the data from the two detection means by the processor. In some embodiments, a plurality of rings controllers can be simultaneously attached, or a plurality of ring controllers configured in a single tubular housing can be used.

In some embodiments the ring controller can be further configured to impart haptic information through forced feedback or other means. For example, the ring controller 60 can have a receiver 68 that is configured to receive a signal from the processor 66 by wired or wireless means. In some preferred embodiments, the receiver 68 is coupled to a signal device 72, such as a vibrator, heat generator, constricting device, and the like. The signal device 72 can be any device that imparts or is configured to create a sensation. Various signal devices can reside on various portions of the ring controller.

Upon receipt of signal from the processor 66, one or more of the signal devices can be can be activated. In some embodiments, the ring controller 60 can include a plurality of receivers each coupled to a separate signal device, or a single receiver can be coupled to more than one signal device, or any combination thereof, wherein the signal received from the processor is differentiated for the particular signal device, or can be transmitted to all or less than all of the signal devices at once for activation.

The activation of the signal devices can be in a manner that correlates to the game displayed in the toilet bowl and/or on the display 70. For example, if the game is to extinguish a fire displayed in the bowl by controlling a fire hose that correlates to the ring controller, prior to the extinguishment of the depicted flames, the processor 66 could send signals to the receiver(s) in the ring controller that trigger the heat emitters that reside, for example, in or on the interior side of the ring controller that produces a heat sensation on the penis. If the game is to extinguish the flames in the mouth of a fire breathing dragon, failure to do so might result in the dragon appearing to bite the "hose". In this case a constricting device on the interior surface of the ring controller or in the ring would constrict in accordance with the game dragon's "bite". Recent developments in plastic films that constrict or elongate depending on the signal sent can be used. The invention contemplates tactile sensory stimulation by means associated with the ring controller that will use advanced plastics and other materials in which nanomachines and nanodevices are embedded or associated therewith.

In some embodiments, a series of ring controllers in an assembly or sequentially mounted can be used to create a sensation of movement of vibration, heat, constriction, and the like, up, down, and/or around the shaft of the penis by sequential triggering of vibration, heat, constriction, etc., devices. Such sequential triggering can be used to correlate with activity depicted in a game and/or in holographic or other images viewable in the bowl. For example if the player's member is depicted in the game display as being grasped and tugged, sequential triggering of the constriction/release devices in a plurality of ring controllers sequentially and concentrically positioned around the penis could be timed to produce a corresponding effect to simulate such tugging on the user's actual member.

It is to be understood that any type of cursor control, such as a joy stick or a push control, can be combined with the stream detection feature of the system, or other control features used in traditional type video games. For example, a push button mouse device can be held in one hand and used in combination with the stream detection/cursor control system, such that the user controls the push button device in one hand while controlling the direction of his urination and cursor with the other hand.

Further, in still other embodiments, a toilet having medical sensing capabilities can be used with embodiments of the invention such that analysis of a participant's urine can be made and forwarded via a computer network to a predesignated doctor, web site or medical facility. Indeed, in some embodiments, the analysis can be stored in a predefined database that collects data for the participant or a medical group. For instance, in some preferred embodiments, the target body could be coated with a compound which can evince intoxication of the urinating user. In this embodiment, if the user is at a bar, notification of the intoxicated user could be sent to the user or personnel of the bar by any suitable means, including, but not limited to, a flashing light, an alarm or any other suitable means for alerting the personnel or the proprietor of the bar. In some preferred embodiments, notification can be used to automatically disable the user's ability to operate his motor vehicle.

In some preferred embodiments, users could voluntarily participate in a system or service utilizing the toilet having medical sensing capabilities to monitor urine content. To participate in the system or service, such as a Drive-Home Program, users or participants would preregister and provide pertinent user information, including, but not limited to, name and contact information, such as, a list of persons to contact to drive the user home or render additional assistance. The information is stored in a database which is accessed upon a determination, for example, that the urine includes some predefined inappropriate substance, such as a chemical or toxin. For example, if an electronic version of the system is employed at a particular establishment, wherein the system is configured to acquire the user's identity (for example, by a user login), or wherein a credit or debit card is used to engage the system, such that the system identifies the user, if a high alcohol level or other intoxicating drug concentration in the user's blood stream is detected, the system accesses the database to determine whether a contact person has been identified for the particular user. The system then transmits a message to the bar personnel, and/or automatically contacts a contact person, or pre-arranged person, to drive the user home. In some embodiments, if no contact person is listed, the bartender arranges for the user's transportation. It is to be understood that the service, such as the Drive-Home Program, can be an independent service, wherein the database storing the user's contact information is separately stored from the target game or detection system discussed herein. In this instance, the target game or detection system accesses a network containing the database or the service's database upon the determination that the urine includes inappropriate substances. In some preferred embodiments, the database for the contact information is contained within the target game system.

Further embodiments also comprise an electronic detection device that senses whether the target members have floated too high. If the target members float too high, a signal is transmitted to a shut off valve, or an alarm that alerts the owner of the facility that the water level in the toilet is rising or is too high and may overflow. In some embodiments, a plumber can automatically be called or, if the system is on a network, an email can be forwarded to a predesignated plumber or other person that a problem may exist.

Still further embodiments include other types of security devices for preventing theft of the game apparatus. In particular, in a public facility, the target game can be coupled to an alarm such that the attempted removal or successful removal of one or more of the target members or a sensor from the toilet causes an alarm to sound, or to send a silent signal to a security facility. In another preferred embodiment, the apparatus is secured with a club-like locking device.

It is to be understood that various embodiments of the invention can be combined to provide multiple purposes, for example, a game having medical analysis benefits. Further, the above disclosure is not intended to limit the invention, but rather, the foregoing is intended to cover all modifications and alternative constructions falling within the spirit and scope of the invention.

What is claimed is:

1. A target game for use in a basin, comprising:

a target body; and a plurality of coupling members, wherein the coupling members secure the target body to the basin, the coupling members further comprising a securing member and an attachment member, wherein the securing member couples to the basin, and wherein the attachment member couples the securing member to the target body, the target body configured to be separable from the coupling members via the application of a downward force of a liquid, the coupling members being configured to remain coupled to the basin, wherein the basin is configured to flush; and wherein the target body comprises an activator, the activator being configured to cause the basin to flush.

* * * * *